US005629729A

United States Patent [19]

Fujishiro

[11] Patent Number: 5,629,729

[45] Date of Patent: May 13, 1997

[54] THERMAL PRINTER AND OPTICAL FIXING DEVICE THEREFOR

[75] Inventor: Takeshi Fujishiro, Saitama, Japan

[73] Assignee: Fuji Photo Film Co., Ltd., Kanagawa, Japan

[21] Appl. No.: 661,724

[22] Filed: Jun. 11, 1996

[30] Foreign Application Priority Data

Jun. 19, 1995 [JP] Japan ..... 7-152062
Sep. 18, 1995 [JP] Japan ..... 7-238447

[51] Int. Cl.[6] ..... B41J 2/32; B41M 5/26

[52] U.S. Cl. ..... 347/175

[58] Field of Search ..... 347/175; 503/227; 400/120.03

[56] References Cited

U.S. PATENT DOCUMENTS 5,486,856 1/1996 Katsuma et al. ..... 347/175
5,565,903 10/1996 Ueda ..... 347/175

FOREIGN PATENT DOCUMENTS 63-33321 9/1988 Japan .
4-54590 8/1992 Japan .

*Primary Examiner*—Huan H. Tran

[57] ABSTRACT

A thermal printer for use with a thermosensitive recording sheet is provided with an optical fixing device which has at least a lamp to optically fix a thermosensitive color developing layer of the recording medium. The lamp extends across a transport path of the recording sheet such that an intermediate portion of the lamp where luminance is approximately uniform extends over a range exceeding a maximum width of the recording sheet. A photosensor is disposed on a lateral side of the recording sheet so as to receive electromagnetic rays from the intermediate portion of the lamp. A control device controls the quantity of electromagnetic rays generated from the lamp in accordance with an illuminance value detected by the photosensor, so as to maintain the illuminance of an illumination area in front of the lamp to be constant.

16 Claims, 11 Drawing Sheets

THERMAL PRINTER AND OPTICAL FIXING DEVICE THEREFOR

BACKGROUND OF THE INVENTION

1. Field of the Invention

The present invention relates to a thermal printer for use with a thermosensitive recording medium, which is provided with a thermal head and at least an optical fixing device. More particularly, the present invention relates to an optical fixing device of a color thermal printer, having a photosensor and a shutter for controlling the amount of light or electromagnetic rays applied for fixing the color thermosensitive recording medium.

2. Background Art

A color thermal printer for use with a color thermosensitive recording medium has been known. The color thermosensitive recording medium has at least three color thermosensitive layers which develop cyan, magenta and yellow when heated. Because the thermosensitive layers have different thermosensitivities for color, a full color image can be thermally recorded in a frame sequential fashion in order from the most sensitive to the least sensitive layer. After recording a color frame in the most sensitive layer, this layer is optically fixed by electromagnetic rays of a specific wavelength range, so as not to develop color any more. Then, a next color frame is recorded in the second sensitive layer, which is, thereafter, fixed by electromagnetic rays of another wavelength range. Finally, recording in the least sensitive layer is executed to complete a full color image.

A lamp for radiating the electromagnetic rays for fixing is mainly an elongated discharge tube, and disposed across a transport path of the thermosensitive recording medium. Because the intensity of light from the lamp changes with the temperature of the tube wall, as described, for example, in JP-Y-63-33321, it is desirable, for uniform optical fixing, to measure light from the lamp and maintain the light intensity of the lamp to be constant based on the measured light value, as is disclosed in JP-B-4-54590.

To avoid interference with the light path from the lamp to the recording medium, a photosensor may not be disposed between the lamp and the recording medium. It is possible to place the photosensor on a rear side of the lamp. However, for the sake of accurate measurement of illuminance on the recording medium, it is preferable to place the photosensor as closer to the recording medium as possible.

Moreover, luminance of the elongated discharge tube changes in the axial direction. That is, the luminance steeply decreases in proximity to the ends of the tube. Accordingly, accurate measurement is impossible with the photosensor being placed in the end portion of the lamp tube, even though the photosensor in that place does not hinder the light path from the lamp toward the recording medium.

Incidentally, there are plural types of printers: a circular type and a back-and-forth type.

In the circular type thermal printer, a sheet of the recording material is mounted around a periphery of a platen drum, to be transported circularly relative to a thermal head. A clamp member clamps an end of the recording sheet to position it on the platen drum. An advantage of the circular type is in that only small area along one end of the recording sheet is needed for positioning at the clamp member. An image can be recorded on the recording sheet only with small margin portions. However, as the platen drum must have a sufficiently large diameter enough to support a recording sheet around it, there is a limit in reducing the size of the circular type printer when it is required to record sheets of a B5 or A4 size. In addition, as the size of the platen drum becomes the larger, a drive motor for the platen drum must have the larger power. Therefore, the circular type is preferable for recording on a sheet of smaller size such as postcard size.

FIG. 10 schematically illustrates a conventional color thermal printer of a back-and-forth type. A pair 15 of transport rollers, consisting of a nip roller 15*a* and a drive roller 15*b*, first nip a front edge of a color thermosensitive recording sheet 10, and transport the recording sheet 10 in forward and reverse directions alternately: the forward direction from a supply tray 11 toward an exit passageway 16, and the reverse direction from the exit passageway 16 to a backward passageway 13.

The recording sheet 10 is squeezed between a platen roller 17 and a thermal head 18, while yellow, magenta and cyan colors are recorded to it. The platen roller 17 has a smaller diameter compared with the above-described platen drum that must support the entire length of the recording sheet 10 therearound.

Downstream from the transport roller pair 15 as viewed in the forward direction, there is disposed an optical fixing device 9, which includes a yellow fixing lamp 9*a* generating ultraviolet rays for yellow fixation, a magenta fixing lamp 9*b* generating ultraviolet rays for magenta fixation, and a reflector 9*c* for reflecting light from the fixing lamps 9*a* and 9*b* toward the recording sheet 10. While the recording sheet 10 is transported in the forward or the reverse direction, the color images are recorded to the coloring layers. Then the fixing device 9 is actuated while the recording sheet 10 is transported in the either of the forward and the reverse directions, to fix the coloring layers photochemically.

The back-and-forth type thermal printer is advantageous in reducing the size of the printer, as the diameter of the platen roller 17 is irrespective of the size of the recording sheet 10. However, the recording sheet 10 should be kept nipped between the transport rollers 15*a* and 15*b* during the thermal recording, so as to achieve an exact color registration with simple sheet transporting mechanism and control operation. Therefore, at least a length L1 of an edge portion of the recording sheet 10 must remain behind the transport roller pair 15, as shown in FIG. 10. As a result, an end portion L1+L2 of the recording sheet 10 extending from its edge 10*a* to a trailing end of the reflector 9*c* in the forward transport direction of the recording sheet 10 cannot be positioned in an illumination area A1 under the fixing device 9, so that this end portion L1+L2 is obliged to be a blank margin.

Especially in a back-and-forth type color thermal printer wherein the fixing lamps 9*a* and 9*b* arranged side by side along the transport path as illustrated in FIG. 10, the magenta fixing lamp 9*b* is located farther from the transport roller pair 15. As a result, even in a portion L4 which precedes to the end portion L1+L2 and is located in the illumination area A1 when the recording sheet 10 stops in the position shown in FIG. 10, a trailing half of the portion L4 remains unfixed with the magenta fixing lamp 9*b*. Moreover, exposure amount of the portion L4 to the fixing lamp 9*a* decreases from the leading end to the trailing end within the portion L4, as the exposure time decreases from the leading end to the trailing end. As a result, an uneven and insufficient fixing condition is provided in the portion L4.

Because such an insufficient fixing condition lowers the quality of the recorded image, it is necessary for a satisfactory quality to avoid recording in the portion L4 as well as in the portion L2+L1. Accordingly, the back-and-forth moving type printer needs to keep a quite large portion L3 (=L1+L2+L4) of the recording sheet 12 out of use for printing. That means the smaller area is available for printing on the recording sheet 10. Especially in such a back-and-forth type printer wherein more than one lamp or a U-shaped lamp is used for fixing one color to allow a higher transport speed of the recording sheet, the illumination area A1 is correspondingly elongated, so that the available area of the recording sheet 10 would be still more reduced.

OBJECT OF THE INVENTION

A prime object of the present invention is to provide an optical fixing device with a photosensor which achieve an accurate measurement of illuminance of an optical fixing device on a recording sheet without hindering the light path from the lamp toward the recording sheet.

Another object of the present invention is to provide a back-and-forth type thermal printer with at least an optical fixing device, which is able to effect sufficiently uniform optical fixation in a largest possible area of the recording sheet.

SUMMARY OF THE INVENTION

According to the present invention, in a thermal printer for use with a thermosensitive recording sheet which is provided with an optical fixing device having at least a lamp to optically fix a thermosensitive color developing layer of the recording sheet, the lamp extends across a transport path of the recording sheet such that an intermediate portion of the lamp where luminance is approximately uniform extends over a range exceeding a maximum width of the recording sheet. A photosensor is disposed on a lateral side of the recording sheet so as to receive electromagnetic rays from the intermediate portion of the lamp.

In this way, an illuminance value detected by the photosensor approximately represents the illuminance on the recording sheet in an illumination area in front of the lamp. A control device controls the quantity of electromagnetic rays generated from the lamp in accordance with the illuminance value detected by the photosensor, so as to maintain the illuminance of the illumination area to be constant.

According to a preferred embodiment of the invention, the thermal printer further comprises a shutter insertable into the illumination area, for shielding the electromagnetic rays from the recording medium, in a direction substantially reverse to the forward direction of the recording medium. The shutter begins to be inserted when the recording sheet stops after being transported in a forward direction from a thermal head to the illumination area, at the same speed as the forward transport speed of the recording sheet. As a result, the trailing end portion of the recording sheet in the forward transport direction is exposed to the electromagnetic rays to the same degree as the preceding portion that has passed through the illumination area.

The shutter has at least an opening formed therethrough in parallel to the lamp, such that the opening is opposed to a low illuminance fraction of the illumination area, when the shutter is inserted in the illumination area, so as to permit supplementing the electromagnetic rays to a portion of the recording medium that stops in the low illuminance fraction.

A photometric slit may preferably be formed through the shutter along the transport path such that a light path from the lamp to the photosensor is formed through the photometric slit. The width of the photometric slit is changed so as partly to stop the light path and thus cause the photosensor to detect a lower illumination value when the shutter is moved in a position where a larger quantity of electromagnetic rays should be applied to the recording medium.

In this way, a largest possible area of the recording sheet can be fixed as equally as possible. Therefore, an image can be printed on a recording sheet with reduced margin portions around the image.

BRIEF DESCRIPTION OF THE DRAWINGS

Other objects and advantages of the present invention will become apparent in the following detailed description of the preferred embodiments when read in connection with the accompanying drawings, wherein like reference numerals designates like or corresponding parts throughout the several views, and wherein.

DETAILED DESCRIPTION OF THE PREFERRED EMBODIMENTS

Figure 1:
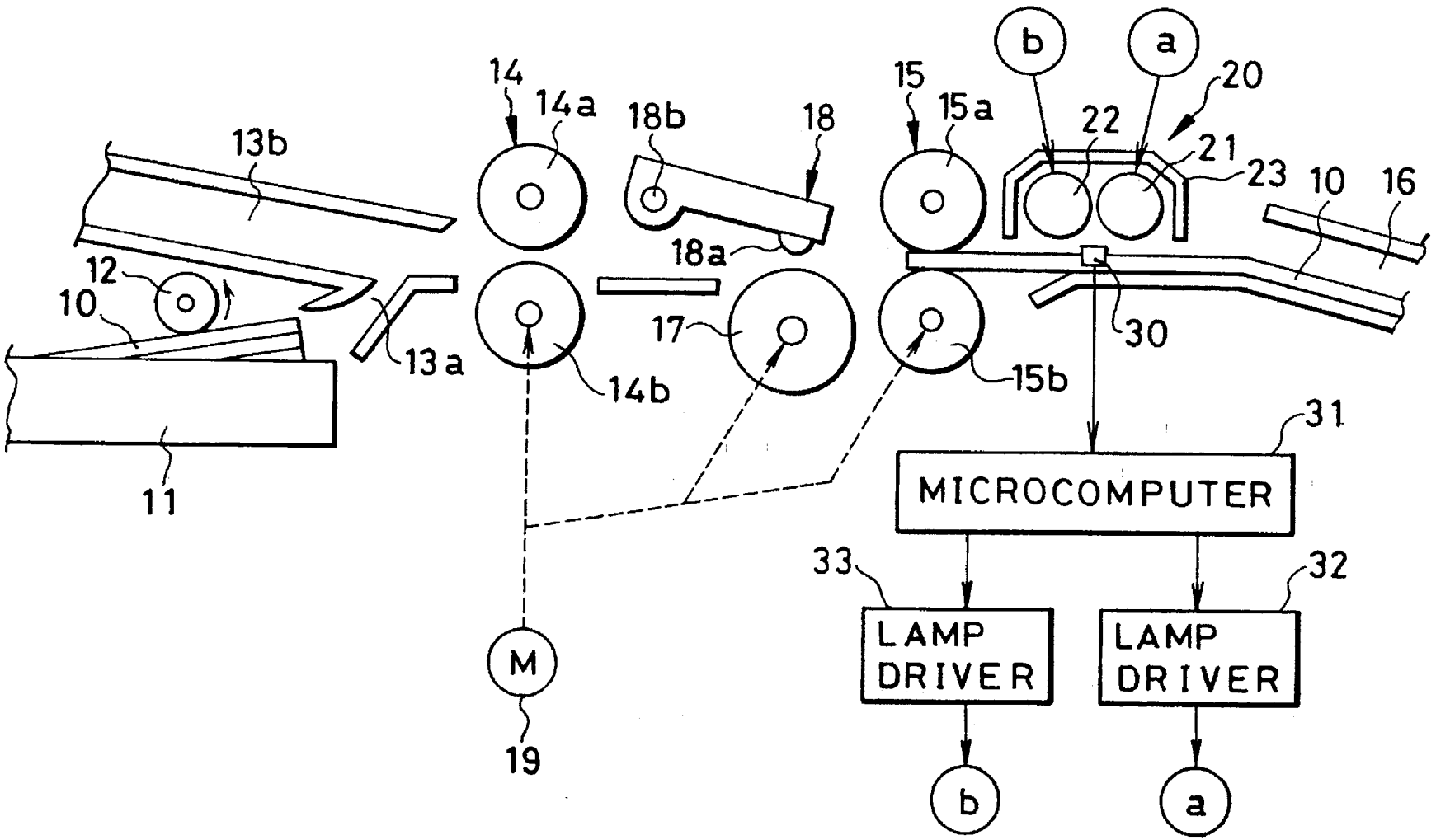
FIG. 1 is a schematic diagram illustrating essential parts of a back-and-forth type color thermal printer having an optical fixing device with a yellow fixing lamp and a magenta fixing lamp, and a photosensor according to a preferred embodiment of the invention.

In a color thermal printer shown in FIG. 1, a sheet of color thermosensitive recording medium 10, hereinafter referred to as a recording sheet 10, is fed out by a supply roller 12 from a supply tray 11, and is transported through a supply passageway 13*a* to a first pair 14 of transport rollers, which is constituted of a drive roller 14*b* and a nip roller 14*a*. The first pair 14 of transport rollers nips and transports the recording sheet 10 toward a platen roller 17 and a thermal head 18.

Behind the platen roller 17 and the thermal head 18, there is a second pair 15 of transport rollers, which is also constituted of a drive roller 15*b* and a nip roller 15*a*. The drive rollers 14*b* and 15*b* and the platen roller 17 are synchronously driven by a motor 19 to rotate at the same peripheral speed in the same direction. The recording sheet 10 is transported in a forward direction from the first pair 14 of transport rollers to an exit passageway 16, and alternately in a reverse direction toward a backward passageway 13*b*, while the recording sheet 10 is kept being nipped between either the first or the second pair 14 or 15 of transport rollers.

An optical fixing device 20 having a pair of lamps 21 and 22 is disposed between the second pair 15 of transport rollers and the exit passageway 16.

The thermal head 18 has an array of heating elements 18*a* as conventional, and is pivotally supported on a shaft 18*b*, so that the thermal head 18 can move between a rest position retracted away from the platen roller 17 and a position contacting the heating elements 18*a* on the platen roller 17 and thus on the recording sheet 10 passing through between the platen roller 17 and the thermal head 18. The thermal head 18 records a full-color image in a frame sequential fashion on the recording sheet 10 while the recording sheet 10 is transported in the forward direction.

Figure 11:
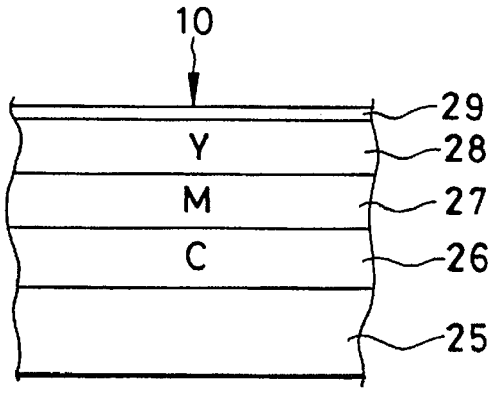
FIG. 11 (PRIOR ART)
FIG. 11 is a schematic sectional view illustrating a layered structure of a color thermosensitive recording medium.

The recording sheet 10 has a multi-layered construction as shown in FIG. 11, wherein a cyan developing thermosensitive layer 26, a magenta developing thermosensitive layer 27, a yellow developing thermosensitive layer 28, and a protection layer 29 are formed on a base material 25 in this order from the base material 25. The base material 25 may be an opaque coated paper or a plastic film, but may be a transparent plastic film to make a print for use on an over-head projector. The frame sequential recording is performed from the yellow to cyan developing thermosensitive layers 28 to 26, that is, in the order from the obverse of the recording sheet 10. These thermosensitive layers 26 to 28 are not necessarily arranged in the order shown in FIG. 11, and the sequence of frame recording varies according to the order of the thermosensitive layers from the obverse.

The cyan developing thermosensitive layer 26 contains an electron donating dye precursor and an electron accepting compound as main components, and is colored cyan when it is heated. The magenta developing thermosensitive layer 27 contains a diazonium salt compound having a maximum absorption factor at a wavelength of about 365 nm and a coupler which acts upon the diazonium salt compound and is colored magenta when it is heated. The magenta developing thermosensitive layer 27 loses its coloring ability when exposed to electromagnetic rays of about 365 nm. The yellow developing thermosensitive layer 28 contains a diazonium salt compound having a maximum absorption factor at a wavelength of about 420 nm and a coupler which acts upon the diazonium salt compound and is colored yellow when it is heated. The yellow developing thermosensitive layer 28 loses its coloring ability when exposed to electromagnetic rays of about 420 nm.

Accordingly, the lamp 21 radiates electromagnetic rays of about 420 nm for fixing the yellow developing thermosensitive layer 28, and the lamp 22 radiates electromagnetic rays of about 365 nm for fixing the magenta developing thermosensitive layer 27. The yellow and magenta fixing lamps 21 and 22 are elongated discharge tubes, which are arranged in parallel in a lateral direction of the recording sheet 10, i.e., in a direction traversing a transport path of the recording sheet 10. The lamps 21 and 22 are alternatively turned on to fix the yellow and then the magenta developing thermosensitive layers 28 and 27. A reflector 23 is provided behind the lamps 21 and 22 to reflect the electromagnetic rays or light from the lamp 21 or 22 toward the recording sheet 10.

Also, a photosensor 30 is disposed on one lateral side of the recording sheet 10 in the approximately same plane as the recording sheet 10. The photosensor 30 may be a photo-diode or a photo-transistor.

Figure 2A:
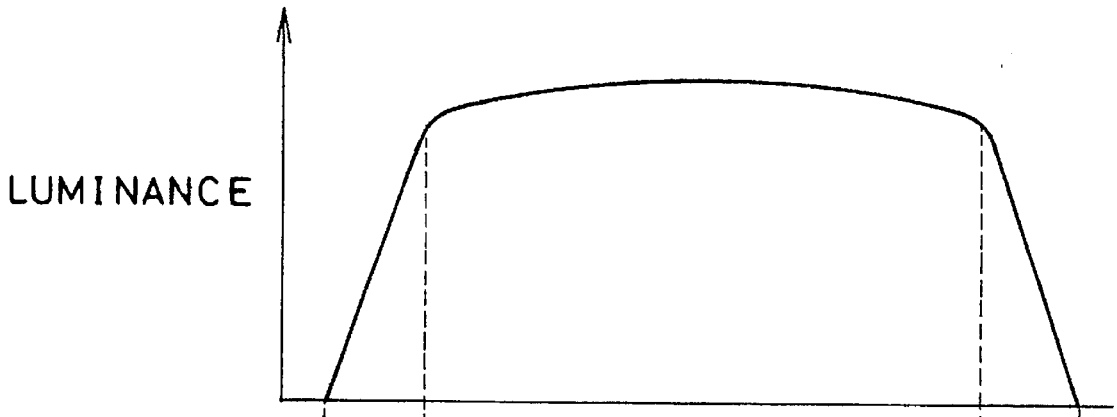
FIG. 2A and 2B are explanatory views illustrating a luminance curve of the yellow fixing lamp in the axial direction thereof, and a relationship between the lamp, the recording sheet and the photosensor in the embodiment of FIG. 1.
Figure 2B:
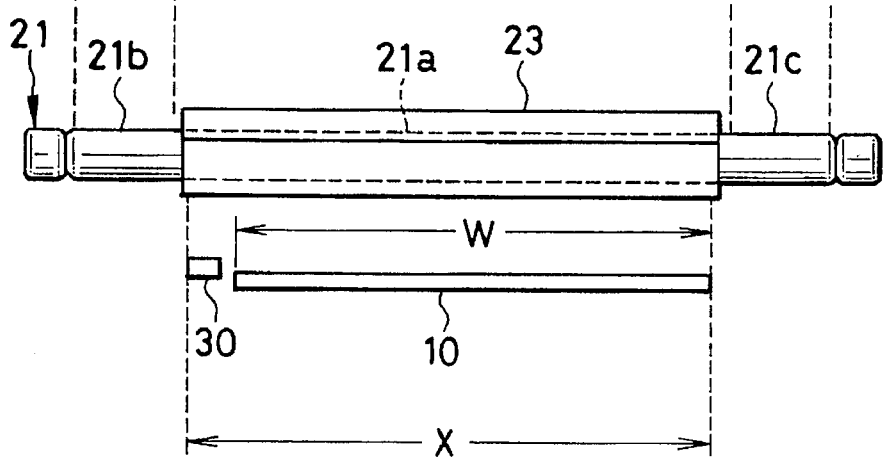

As shown in FIG. 2A, luminance of the yellow fixing lamp 21 is approximately uniform and maximum in an intermediate portion 21*a* of its tube, but steeply decreases in end portions 21*b* and 21*c* of the tube. Therefore, the yellow fixing lamp 21 has a length sufficiently more than a maximum width W of the recording sheet 10 such that the intermediate portion 21*a* with the approximately uniform luminance extends across a range X which covers the width W of the recording sheet 10 and the photosensor 30 as well, as is shown in FIG. 2B. In other words, the end portions 21*b* and 21*c* of the lamp 21 exceed the range X. The recording sheet 10 may have a smaller width than the maximum width W. The magenta fixing lamp 22 is arranged in the same way as the yellow fixing lamp 21, relative to the recording sheet 10 and the photosensor 30, so that the photosensor 30 may measure the quantity of electromagnetic rays from either of the lamps 21 and 22 on the same conditions.

Thus, the photosensor 30 detects an illuminance value of the lamp 21 or 22 which is approximately equal to the illuminance on the recording sheet 10. The illuminance signal from the photosensor 30 is sent to a microcomputer 31, which controls either of lamp drivers 32 and 33 based on the illuminance signal. The lamp drivers 32 and 33 may control the quantity of light or electromagnetic rays from the lamps 21 and 22, respectively, for example, by adjusting pulse duty factor of drive pulses applied to the lamp 21 or 22, or by adjusting voltage supplied to the lamp 21 or 22.

The above-described color thermal printer operates as follows:

In response to a print start command, the supply roller 12 starts rotating to feed out a topmost recording sheet 10 from a pile in the supply tray 11 toward the first pair 14 of transport rollers.

Simultaneously with the sheet feeding, the yellow fixing lamp 21 is turned on, so that the photosensor 30 measures the illuminance of the yellow fixing lamp 21. Because the photosensor 30 is disposed on one lateral side of the recording sheet 10, i.e., out of a zone between the recording sheet 10 and the optical fixing device 20, the photosensor 30 will not interfere with the light applied to the recording sheet 10, nor receive light reflected from the recording sheet 10. Moreover, because the photosensor 30, as well as the recording sheet 10, receives light from the intermediate portion 21*a* of the lamp 21 where the luminance is approximately uniform and maximum, the photosensor 30 can detect an illuminance value that is approximately equal to the illuminance on the recording sheet 10.

The illuminance signal from the photosensor 30 is sent to the microcomputer 31, which controls the lamp driver 32 based on the illuminance signal. If the measured illuminance is less than a standard level, the lamp driver 32 increases the quantity of light applied from the lamp 21. If the measured illuminance is more than the standard level, the lamp driver 32 reduces the quantity of light from the lamp 21. Thus, the illuminance on the recording sheet 10 is maintained constant.

The motor 19 drives the drive rollers 14*b* and 15*b* and the platen roller 17 to transport the recording sheet 10 in the forward direction. When the leading end of the recording sheet 10 reaches the platen roller 17, the thermal head 18 is brought into contact with the recording sheet 10, to start recording a yellow frame of a full-color image line by line in synchronism with the transport of the recording sheet 10. The recording sheet 10 is continuously transported toward the optical fixing device 20, so that the yellow developing thermosensitive layer 28 is optically fixed by the light or electromagnetic rays from the yellow fixing lamp 21. After the yellow frame is completely recorded to the yellow developing thermosensitive layer 28, the thermal head 18 is deactivated and set back to the rest position.

During the optical fixing of the yellow developing thermosensitive layer 28, illuminance on the recording sheet 10 is maintained constant through the photosensor 30, the microcomputer 31 and the lamp driver 32. Therefore, the yellow developing thermosensitive layer 28 is uniformly fixed in the entire recording area of the recording sheet 10. When the trailing end of the recording sheet 10 reaches the second pair 15 of transport rollers, the yellow fixing lamp 21 is turned off. Simultaneously, the motor 19 drives the drive rollers 14*b* and 15*b* and the platen roller 17 to rotate in the reverse direction, to move the recording sheet 10 back to the recording start position where the leading end of the recording sheet 10 is on the platen roller 17.

Thereafter, the magenta fixing lamp 22 is turned on, so that the photosensor 30 outputs an illuminance signal to the microcomputer 26. The microcomputer 26 controls the quantity of light from the magenta fixing lamp 22 through the lamp driver 33 in accordance with the illuminance signal in the same way as for the yellow fixing lamp 21. Then, the motor 19 starts rotating the drive rollers 14*b* and 15*b* and the platen roller 17 in the forward direction again, and the thermal head 18 starts recording a magenta frame line by line to the magenta developing thermosensitive layer 27.

The recording sheet 10 is continuously transported toward the optical fixing device 20, so that the magenta developing thermosensitive layer 27 is optically fixed by the light or electromagnetic rays from the magenta fixing lamp 22. After the magenta frame is completely recorded to the magenta developing thermosensitive layer 27, the thermal head 18 is deactivated and set back to the rest position.

During the optical fixing of the magenta developing thermosensitive layer 27, illuminance on the recording sheet 10 is maintained constant through the photosensor 30, the microcomputer 31 and the lamp driver 33. Therefore, the magenta developing thermosensitive layer 27 is uniformly fixed in the entire recording area of the recording sheet 10. Because the electromagnetic rays of about 365 nm do not adversely affect the recording sheet 10 even when their amount is excessive, it is possible to control the magenta fixing lamp 22 so as to maintain the illuminance above the constant level.

When the trailing end of the recording sheet 10 reaches the second pair 15 of transport rollers, the magenta fixing lamp 22 is turned off. Simultaneously, the motor 19 drives the drive rollers 14*b* and 15*b* and the platen roller 17 to rotate in the reverse direction, to move the recording sheet 10 back to the recording start position where the leading end of the recording sheet 10 is on the platen roller 17.

When the recording sheet 10 is set in the recording start position, the motor 19 starts rotating the drive rollers 14*b* and 15*b* and the platen roller 17 in the forward direction again, and the thermal head 18 starts recording a cyan frame line by line to the cyan developing thermosensitive layer 26. Because the cyan developing thermosensitive layer 26 requires heat energy of more than about 80 $mJ/mm^2$ to develop color, the cyan developing thermosensitive layer 26 can hardly develop color in ordinary circumstances. For this reason, the cyan developing thermosensitive layer 26 does not have to be fixed. However, the magenta fixing lamp 22 is turned on for bleaching non-imaged areas of the recording sheet 10 after the cyan frame recording.

After the cyan frame recording, the recording sheet 10 is transported further in the forward direction to be discharged through the discharge passageway 16. The motor 19 stops when the trailing end of the recording sheet 10 passes the second pair 15 of transport rollers.

Although the optical fixing device 20 of the above-described embodiment has the reflector 23 behind the lamps 21 and 22, it is possible to replace the reflector 23 with reflection layers, such as deposited aluminum layers, formed on the inner or the outer peripheries of the tubes of the lamps 21 and 22 in the rear sides from the recording sheet 10. It is also possible to provide a specific photosensor to each of the lamps 21 and 22 in the arrangement as shown in FIG. 2B. The lamps 21 and 22 should not necessarily be of an elongated linear shape, but may have another shape such as an U-shape. In this case, both ends of the U-shaped lamp should extend beyond the same lateral side of the recording sheet, whereas the turned middle portion should extend over the range X covering the photosensor 30 and the width of the recording sheet as well.

The arrangement shown in FIG. 2 is applicable to an optical fixing device of a circular type thermal printer using a platen drum.

Next, another embodiment of the present invention will be described with reference to FIG. 3. A thermal printer of this embodiment has an optical fixing unit 41 wherein first and second optical fixing devices 42 and 43 are supported on a supporting member 44 to be alternatively placed in a fixing position facing a recording sheet 10. Also, a shutter 47 is provided to be insertable into between the recording sheet 10 and the optical fixing device set in the fixing position. In this embodiment, those elements which may be equivalent to the first embodiment are designated by the same reference numerals, so that the following description relates merely to essential parts to the second embodiment.

The fixing position is located closer to the second pair 15 of transport rollers, so as to minimize unsatisfactory fixed or unfixed margin of the recording sheet 10.

A head pressing mechanism 36 is provided to move a thermal head 18 between a rest position retracted away from a platen roller 17 and a position contacting heating elements 18*a* on the platen roller 17 and thus on the recording sheet 10 passing through between the platen roller 17 and the thermal head 18. The thermal head 18 is under the control of a print controller 37, which includes three color frame memory for storing image data by color and drives the heating elements 18*a* in accordance with the image data to record a full-color image at desired densities according to a frame sequential fashion.

The first optical fixing device 42 is constituted of a yellow fixing lamp 42*a* and a reflector 50. The second optical fixing device 43 is constituted of a magenta fixing lamp 43*a* and a reflector 51. The yellow fixing lamp 42*a* has a peak at about 420 nm for fixing the yellow developing thermosensitive layer 28. The magenta fixing lamp 43*a* has a peak at about 365 nm for fixing the magenta developing thermosensitive layer 27.

The optical fixing devices 42 and 43 are mounted to a supporting member 44 which is rotatable about a rotary shaft 52 by 105 degrees so that one of the optical fixing devices 42 and 43 is placed in the operating position facing the guide plate 23. The rotary shaft 52 of the supporting member 44 is supported rotatable on a main body 45. The main body 45 is supported on a stay 53 through a rotary shaft 54 to be rotatable through an angle of 10 degrees between an operating position shown by solid lines and a rest position shown by phantom lines. The main body 45 and the supporting member 44 are interconnected to each other through an interconnection mechanism 46, such that the supporting member 44 is rotated by 105 degrees while the main body 45 is set in the rest position. The interconnection mechanism 46 is constituted of a motor, a gear train, a clutch and so forth, though they are not shown in the drawings.

Figures 4A, 4B, 4C, 4D:
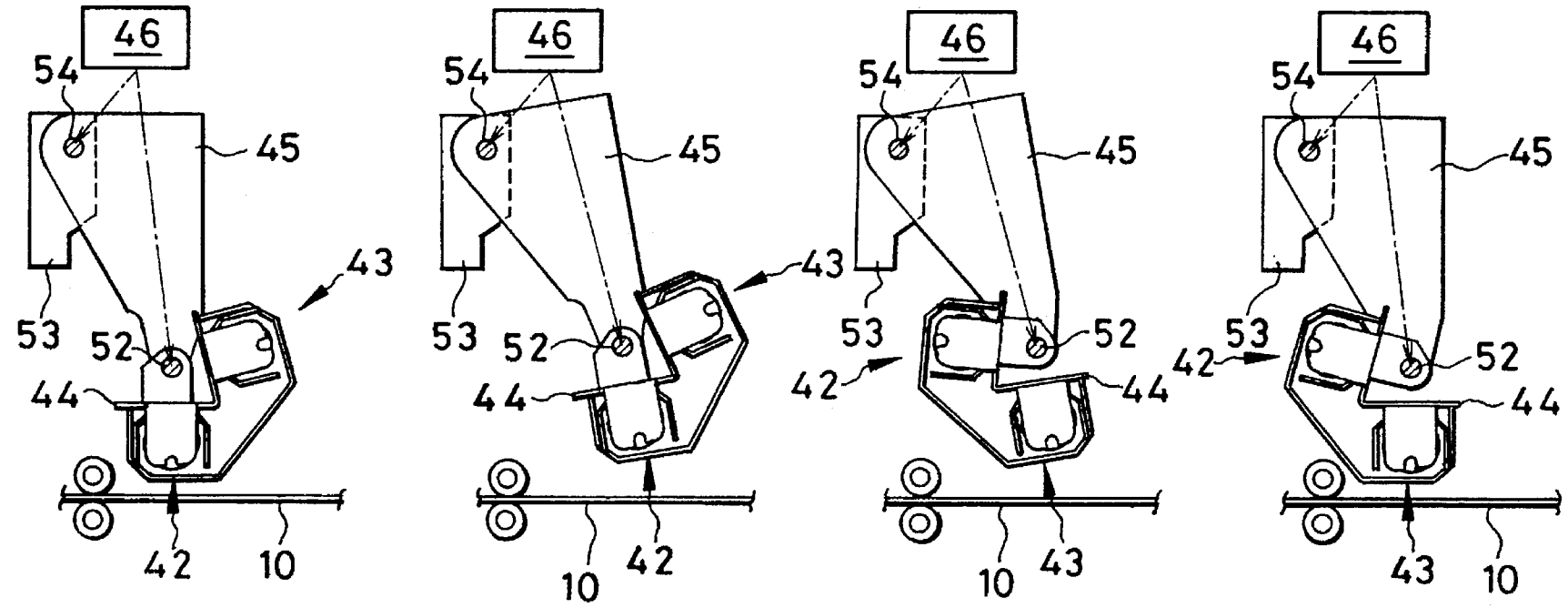
FIGS. 4A, 4B, 4C and 4D are explanatory views illustrating a switching operation between the optical fixing devices of FIG. 3.

FIGS. 4A to 4D illustrate the operation of the interconnection mechanism 46. The main body 45 is rotated by 10 degrees in a counterclockwise direction from the position shown in FIG. 4A, that is a yellow fixing position of the optical fixing unit 41, to the rest position shown in FIG. 4B. Then, the supporting member 44 is rotated clockwise by 105 degrees, as shown in FIG. 4C. Thereafter, the main body 45 is rotated clockwise by 10 degrees to return to the initial position. Thus, a magenta fixing position of the optical fixing unit 41 is provided, wherein the second optical fixing device 43 is placed in the fixing position as shown in FIG. 4D. When switching from the magenta fixing position to the yellow fixing position, the main body 45 and the supporting device 44 are rotated in reverse order, i.e., from FIG. 4D to 4A. The interconnection mechanism 46 may be controlled by cams and links, or electromagnetic clutch brakes or the like.

Figure 3:
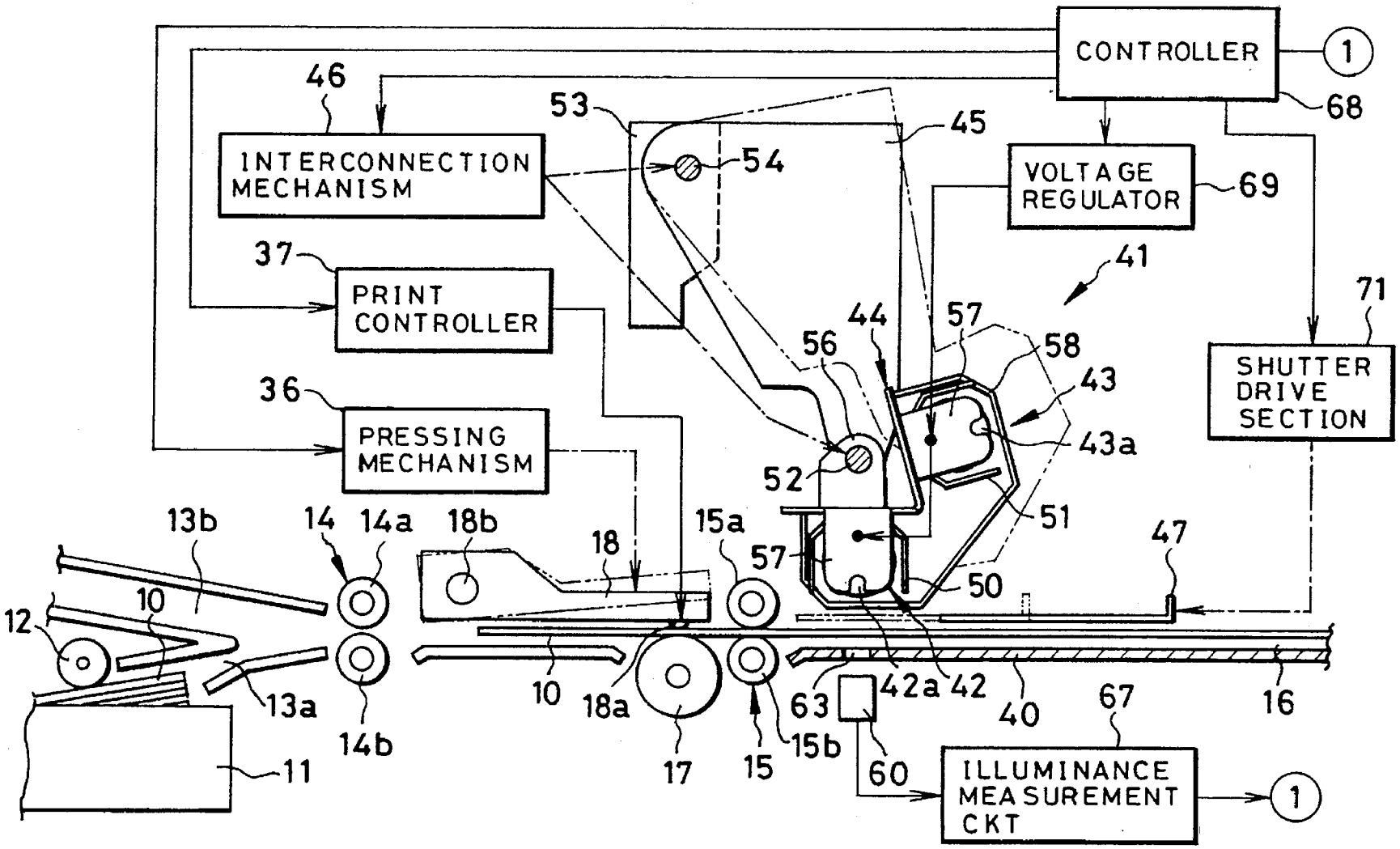
FIG. 3 is a schematic diagram illustrating essential parts of a back-and-forth type color thermal printer with a pair of movable optical fixing devices, a photosensor and a shutter according to another preferred embodiment of the invention.

As shown in FIG. 3, the supporting member 44 is a V-shaped plate with which a base pivoting portion 56 and lamp brackets 57 are integrally formed, and are rotatable together about the rotary shaft 52. The angle of the V-shaped plate may be 75 degrees, The reflectors 50 and 51 are attached to the supporting member 44. The first and second optical devices 42 and 43 supported on the lamp brackets 57 are rotationally symmetrical about the axis of the rotary shaft 52. A lamp cover 58 is mounted to the supporting member 44 to cover end portions of the lamps 42*a* and 43*a*.

Figure 5:
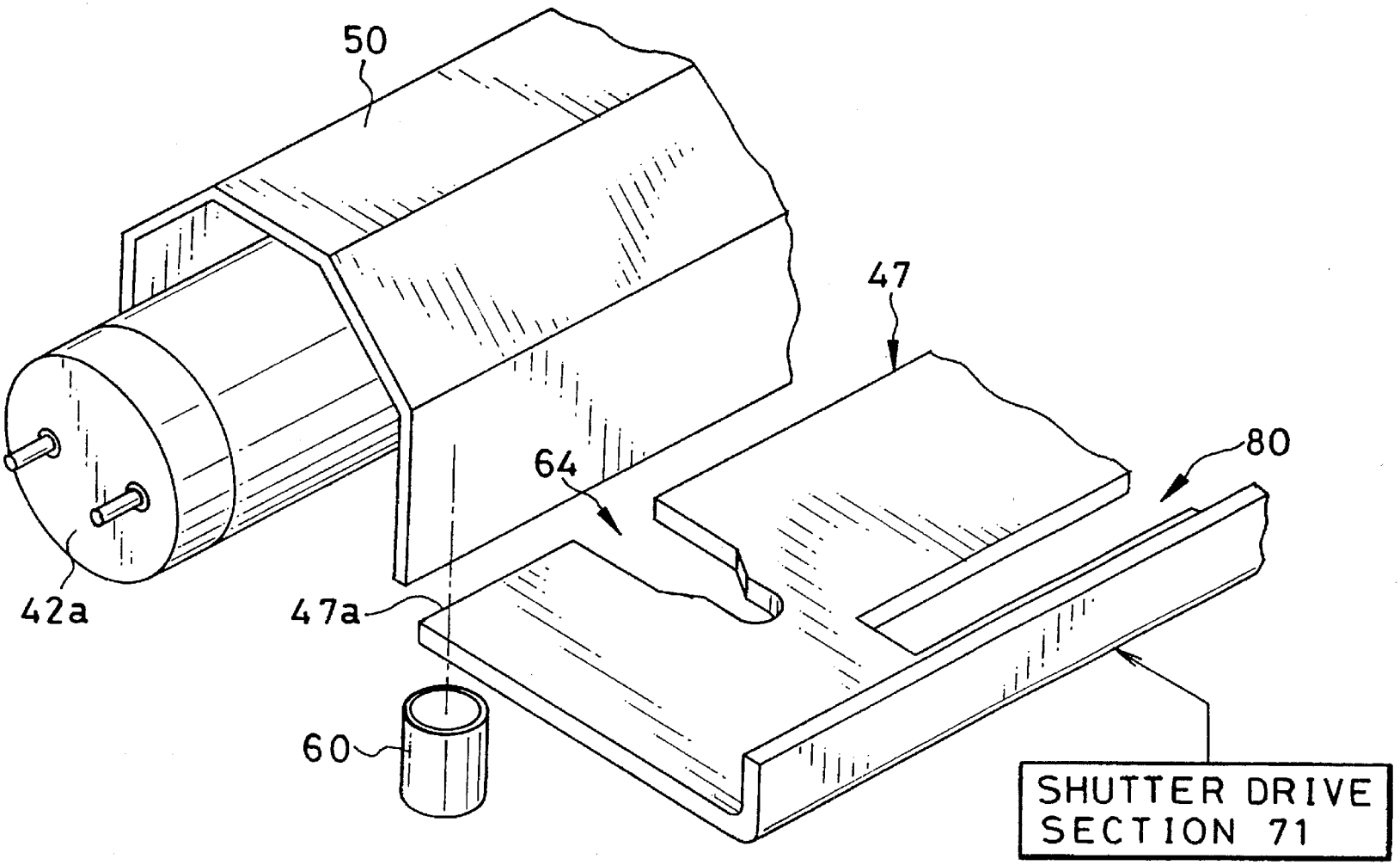
FIG. 5 is a perspective view illustrating the optical fixing device, the shutter and the photosensor according to the embodiment of FIG. 3.

A photosensor 60 is disposed below the guide plate 40, and a light aperture 63 is formed through the guide plate 40 to provide a light path to the photosensor 60 from the lamp 42*a* or 43*a* of the optical fixing device 42 or 43 set in the fixing position. As shown in FIG. 5, the photosensor 60 is disposed below an intermediate portion of the lamp 42*a* (that can be the lamp 43*a*) where the luminance is approximately uniform and maximum. As shown in FIG. 6B, the lamp 42*a* or 43*a* extends across and beyond the width of the recording sheet 10, and the photosensor 60 is located outside the course of the recording sheet 10.

According to this arrangement, the photosensor 60 can measure an illuminance value which is substantially equal to the illuminance on the recording sheet 10 in the fixing position. Alternatively, the photosensor 60 may be disposed on one lateral side of the guide plate 40 so as to place a light receiving surface 60*a* of the photosensor 60 in the same plane as the recording sheet 10. In this modification, the light aperture 63 is omitted, and the width of the guide plate 40 should be reduced correspondingly, or the length of the lamps 42*a* and 43*a* should be elongated.

The photoelectric signal from the photosensor 60 is sent to an illuminance measurement circuit 67, which derives an illuminance signal from the photoelectric signal. The illuminance signal is sent to a controller or microcomputer 68, which calculates a drive voltage to the lamp 42*a* or 43*a* and sends it to a voltage regulator 69 for maintaining the quantity of light applied from the lamp 42*a* or 43*a* constant. These illuminance measurement circuit 67, the controller 68 and the voltage regulator 69 constitute an illuminance control section.

The shutter 47 is oriented parallel to the recording sheet 10, and is movable along the transport path of the recording sheet 10 between a closed position for shielding the recording sheet 10 from the electromagnetic rays that are projected from the optical fixing device 42 or 43 in the fixing position, as shown by phantom lines in FIG. 3, and an open position retracted from the fixing position, as shown by solid lines in FIG. 3.

Figure 6A:
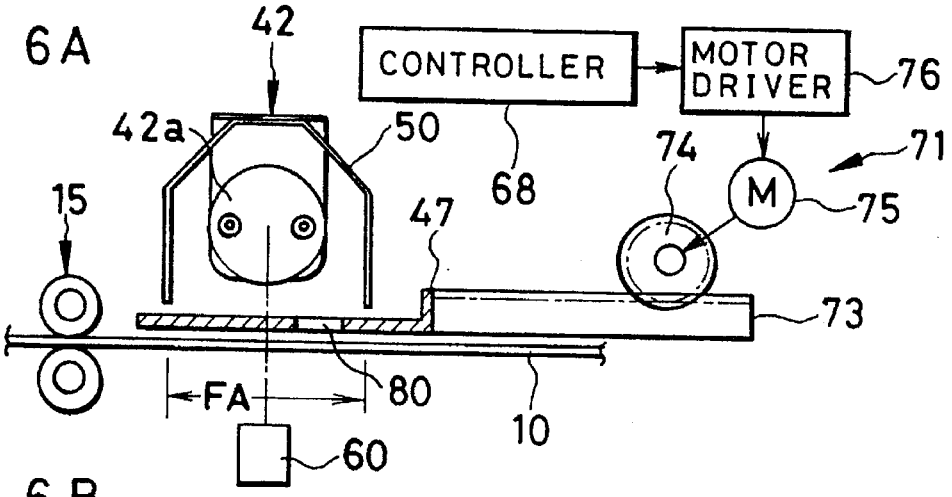
FIGS. 6A, 6B and 6C are explanatory views illustrating the relationship between the lamp of the optical fixing device, the shutter and a total exposure amount of a trailing end portion of the recording sheet, according to the embodiment of FIG. 3.
Figure 6B:
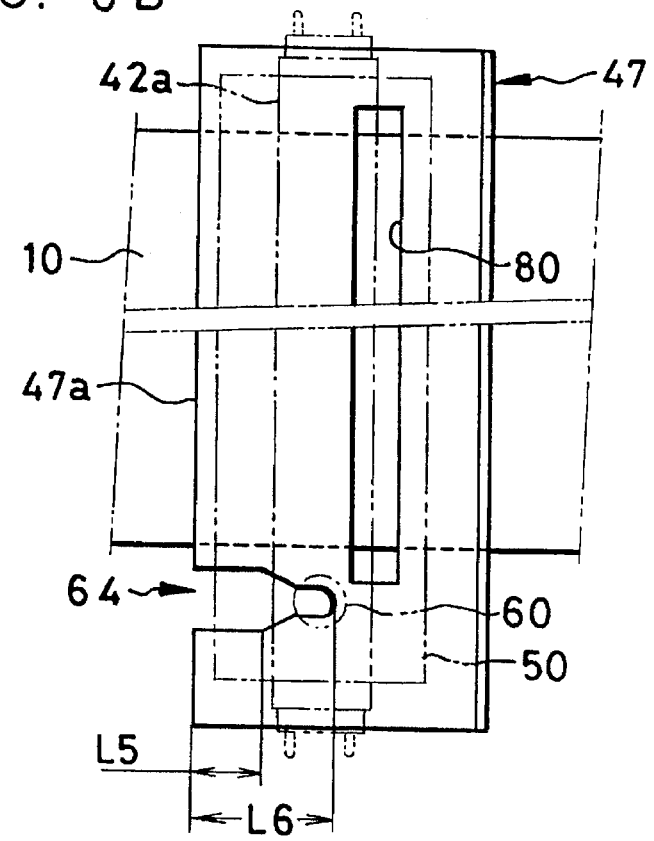

Referring to FIG. 6A, a shutter drive section 71 is constituted of a rack 73 and a pinion 74, and a pulse motor 75 for rotating the pinion 74. The pulse motor 75 is driven by a motor driver 76 under the control of the controller 68. The shutter 47 is determined to move to the closed position at the same speed as the transport speed of the recording sheet 10 in the forward direction. Of course, the shutter drive section 71 may have another transmission mechanism for transmitting the rotational movement of the pulse motor 75 to the shutter 47. For example, a slider-crank mechanism or a link mechanism may be substituted for the rack-pinion mechanism.

As described with respect to the background art, a trailing end portion of the recording sheet cannot be uniformly fixed in the back-and-forth type thermal printer. The shutter 47 is provided for equalizing the exposure amount of the trailing end portion of the recording sheet 10 to the electromagnetic rays, and thus achieve a sufficiently uniform optical fixation. It is to be noted that over-exposure to the electromagnetic rays of about 420 nm would damage the recording sheet 10, so that it is necessary to maintain the quantity of light applied from the yellow fixing lamp 42*a* as constant as possible during the yellow fixing. On the contrary, over-exposure to the electromagnetic rays of about 365 nm would not damage the recording sheet 10. Therefore, the magenta fixing lamp 43*a* has only to apply a larger amount of light than a predetermined level. It is unnecessary for the magenta fixing to insert the shutter 47 and limit the light amount up to a predetermined maximum level.

The shutter 47 begins to be inserted into front of the optical fixing device 42 at the same speed as the forward transport speed of the recording sheet 10, in the reverse direction to the forward transport direction, immediately after the recording sheet 10 stops being transported in the forward direction for the yellow frame recording.

Figure 12A:
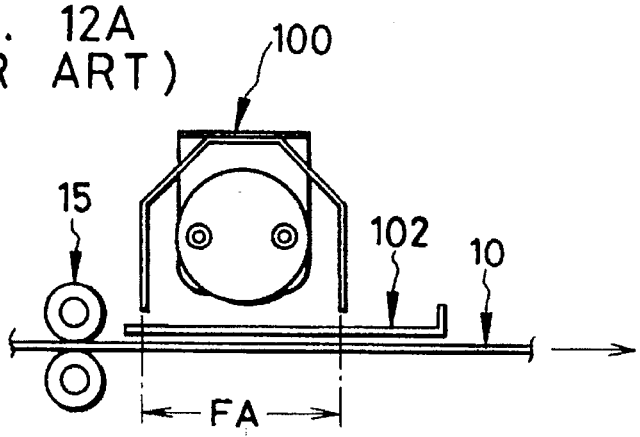
FIG. 12A (PRIOR ART)
FIG. 12A is a schematic diagram illustrating an optical fixing device with a conventional shutter.
Figure 12B:
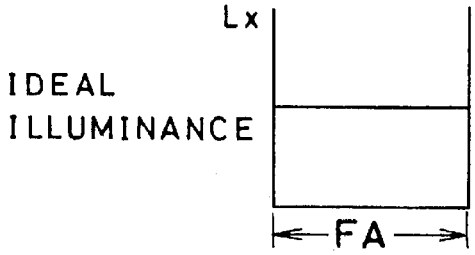
FIG. 12B is a diagram illustrating an ideal uniform illuminance distribution in an illumination area in front of the optical fixing device of FIG. 12A.
Figure 12F:
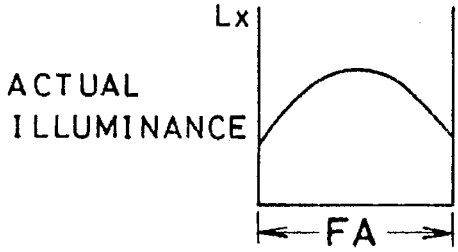
FIG. 12F is a diagram illustrating an actual illuminance distribution in the fixing area of FIG. 12A.
Figure 12C:
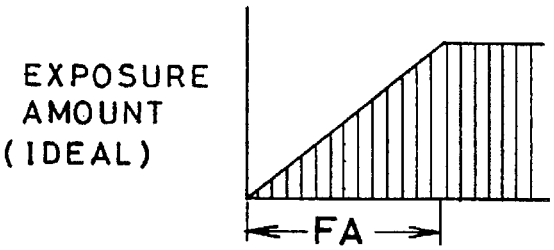
FIG. 12C is a diagram illustrating an exposure amount of the recording sheet obtained in the end of forward transport through the ideal illumination area, before insertion of the shutter.

Meanwhile, if the illuminance were uniform throughout the illumination area, as shown in FIG. 12B, the quantity of light having been applied to the recording sheet 10 until the recording sheet 10 stops being transported in the forward direction shows a curve as shown in FIG. 12C, wherein the exposure amount proportionally decreases from a constant level to zero from the leading end to the trailing end of the trailing end portion of the recording sheet 10 that stays in the illumination area FA.

Figure 12D:
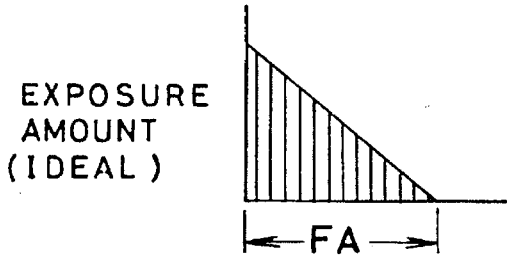
FIG. 12D is a diagram illustrating an exposure amount of a trailing end portion of the recording sheet staying in the ideal illumination area, obtained from the start to the end of shutter insertion.
Figure 12E:
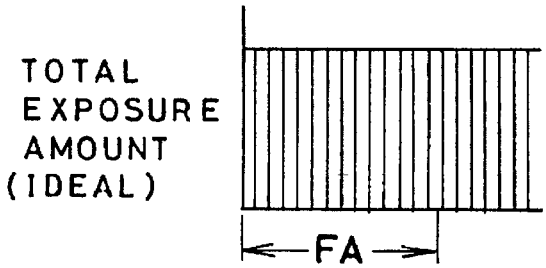
FIG. 12E is a diagram illustrating a total exposure amount of the trailing end portion of the recording sheet, obtained in the end of shutter insertion in the ideal illumination area.

In case of a known optical fixing device 100 having a shutter 102 with no opening or cut-out, as shown in FIG. 12A, the exposure amount of the trailing end portion of the recording sheet 10 in a time period from the start to the end of insertion of a shutter would be as shown in FIG. 12D, if the illumination area FA has the uniform illuminance distribution as shown in FIG. 12B. That is, the exposure amount of the recording sheet 10 would proportionally increase from zero to the constant level from the leading end to the trailing end of the illumination area FA. Accordingly, the total exposure amount would be uniform throughout the illumination area FA, as shown in FIG. 12E, as a result of shutter insertion.

Figure 12G:
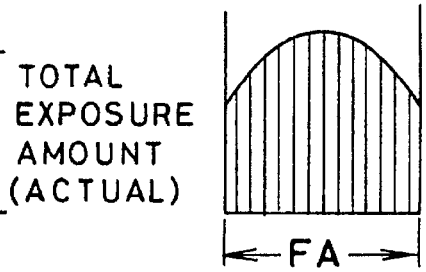
FIG. 12G a diagram illustrating a total exposure amount of the trailing end portion of the recording sheet, obtained in the end of shutter insertion in the actual illumination area.

However, the illuminance in the illumination area FA is actually not uniform but has a curve as shown FIG. 12F, that is, the illuminance is depressed in both leading and trailing end fractions of the illumination area FA. Therefore, the total exposure amount of the trailing end portion of the recording sheet 10 would actually be as shown in FIG. 12G even in the end of the shutter insertion.

To solve this problem, the shutter 47 has a lateral opening 80 which extend laterally to the transport path of the recording sheet 10, as shown in FIGS. 5 and 6B. The lateral opening 80 is arranged to be opposed to a leading end zone of an illumination area FA with respect to the forward transport direction of the recording sheet 10, when the shutter 47 is in the closed position, as shown in FIG. 6B. The illumination area FA is limited under the reflector 50 or 51 of the optical fixing device 42 or 43 set in the fixing station. The lateral opening 80 moves in the illumination area FA immediately before the shutter 47 completes the movement to the closed position, so that the electromagnetic rays fall on the leading end zone of the illumination area FA through the lateral opening 80. As a result, the total exposure amount of the leading end fraction of the illumination area FA increases compared with the case as above where the shutter 102 has no such lateral opening, as indicated by an obliquely hatched portion CA1 in FIG. 6C.

As shown in FIG. 5 and 6B, the shutter 47 further has a photometric slit 64 that is cut from an end edge 47*a* of the shutter 47 that is a leading edge with respect to the inserting direction of the shutter 47 that is reverse to the forward transport direction of the recording sheet 10. The photometric slit 64 is arranged to cross the light path from the lamp 42*a* or 43*a* to the photosensor 60. The photometric slit 64 is widened toward the leading edge 47*a*. Specifically, in a length L5 from the leading edge 47*a*, the photometric slit 64 has such a width that does not stop the light falling on the photosensor 60, but beyond the length L5, the width of the photometric slit 64 decreases toward an internal end thereof. According to this configuration, as the shutter 47 moves toward the closed position, the light falling onto the photosensor 60 is gradually stopped, so that the photoelectric signal from the photosensor 60 decreases correspondingly.

As described above, the illuminance control section 67 to 69 is designed to control the drive voltage to the yellow fixing lamp 42*a* based on the photo-electric signal from the photosensor 60 such that the lower the photo-electric signal becomes, the higher drive voltage is supplied to the yellow fixing lamp 42*a*. Thus, the intensity of the yellow fixing lamp 42*a* gradually increases in the last stage of the shutter insertion. Consequently, due to the increase in illuminance, the integrated or total exposure amount obtained in the end of shutter insertion is still increased by an increment CA2, in addition to the increment CA1 obtained through the lateral opening 80.

The entire length L6 of the photometric slit 64 is determined in accordance with the position of the photosensor 60 relative to the shutter 47 in the closed position.

The controller 68 also counts motor drive pulses supplied to a not-shown pulse motor for rotating the drive rollers 14*b* and 15*b* and the platen roller 17, and controls the respective elements 36, 37, 46 and so forth in synchronism with the transport of the recording sheet 10.

The above-described color thermal printer operates as follows:

In response to a print start switch being actuated, a topmost sheet of recording sheet 10 piled in the supply tray 11 is fed out by the paper feed roller 12 toward the first pair of transport rollers 14. when the recording sheet 10 is nipped between the transport rollers 14, the paper feed roller 12 stops feeding.

The first pair 14 of transport rollers transport the recording sheet 10 through between the platen roller 17 and the thermal head 18. After a leading end of the recording sheet 10 is nipped between the second pair 15 of transport rollers, when the recording sheet 10 moves in a predetermined position, then the head pressing mechanism 36 rotates the thermal head 18 in the clockwise direction in FIG. 3 to bring the heating elements 18*a* into contact with the recording sheet 10. Thereafter, the first pair of transport rollers 14 release the recording sheet 10.

Thus, the recording sheet 10 is transported further in a forward direction through the second pair 15 of transport rollers, while the thermal head 18 records a yellow frame line by line in the yellow developing thermosensitive layer 28 by driving the heating elements 18*a* in accordance with yellow frame image data in a conventional manner. Synchronously with the yellow frame recording, the yellow fixing lamp 42*a* of the first optical fixing device 42 is turned on to project electromagnetic rays of about 420 nm toward the recording sheet 10, thereby fixing the yellow developing thermosensitive layer 28.

Figure 7:
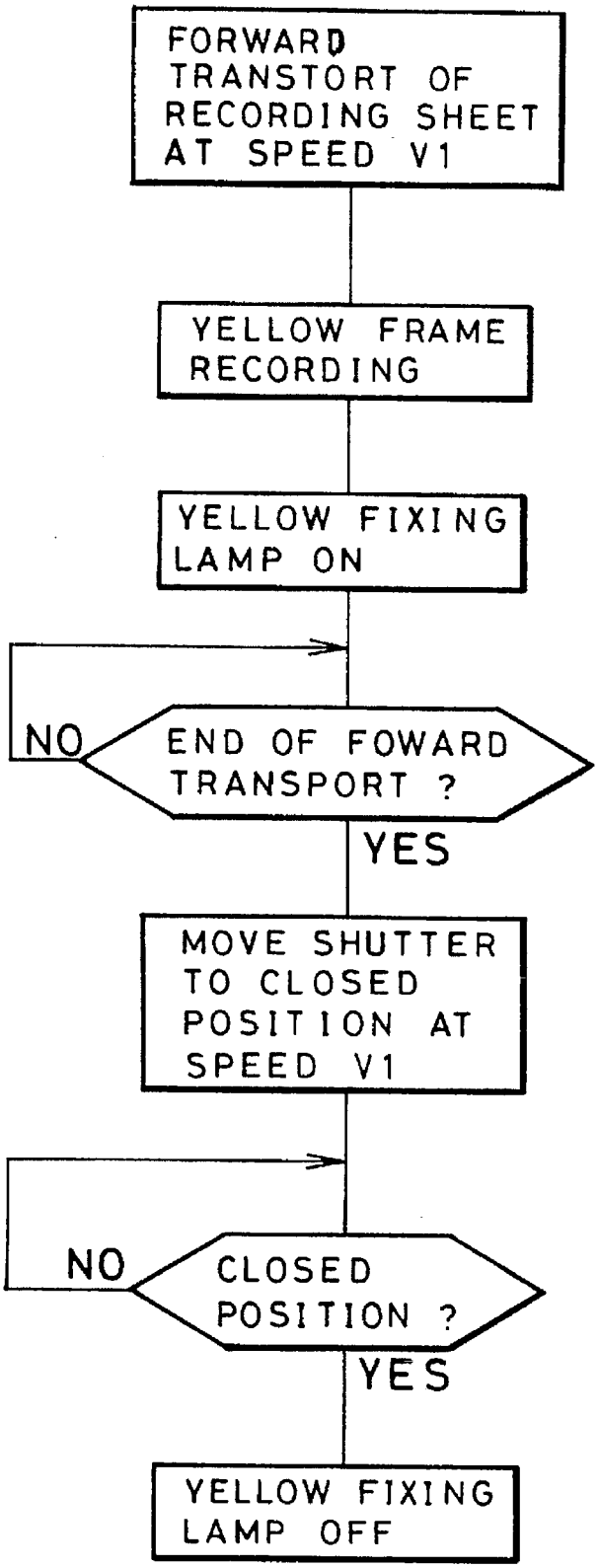
FIG. 7 is a flow chart illustrating a sequence of operation of the thermal printer shown in FIG. 3.

When the yellow frame has been recorded and fixed, where the trailing end of the recording sheet 10 is nipped by the second pair 15 of transport rollers, the thermal head 18 is moved back to the rest position, and the first and second pairs 14 and 15 of transport rollers pause for a moment. Immediately thereafter, the shutter drive section 71 is activated to close the shutter 47 at the same speed V1 as the transport speed of the recording sheet 10 in the forward direction. FIG. 7 shows the sequence of yellow frame recording and fixing.

Figure 6C:
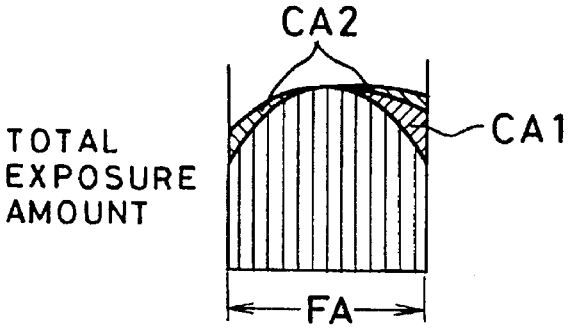

Because the lateral opening 80 is formed through the shutter 47, the electromagnetic rays are applied again to the leading end fraction of the trailing end portion of the recording sheet 10 staying in the illumination area FA, in the end stage of the shutter insertion, so that the lack of illuminance in the leading end fraction of the illumination area FA is compensated for, as shown by CA1 in FIG. 6C. In addition, because of the photometric slit 64 with increasing width toward the trailing edge 47*a* of the shutter 47, the intensity of the yellow fixing lamp 42*a* increases in the end stage of the shutter closing, so that the lack of illuminance in the end fractions of the illumination area FA is compensated for, as shown by CA2 in FIG. 6C. In this way, the yellow developing thermosensitive layer 28 is sufficiently uniformly fixed even in the trailing end of the recording sheet 10.

When the shutter 47 completes closing, the yellow fixing lamp 42*a* is turned off, and then the shutter 47 is moved back to the open position by the shutter drive section 71. Then, the first and second pairs 14 and 15 of transport rollers start rotating reversely to transport the recording sheet 10 in a backward direction. At that time, the trailing end of the recording sheet 10 is guided to a backward passageway 13*b*.

While the recording sheet 10 is transported backward, the interconnection mechanism 46 operates to replace the first optical fixing device 42 with the second optical fixing device 43 in the manner as described with reference to FIGS. 4A to 4D.

Thereafter when the predetermined position in the leading end of the recording sheet 10 reaches again to the heating elements 18*a*, the first and second pairs 14 and 15 of transport rollers pause for a moment, and the thermal head 18 is set to the operating position again. Then, the first and second pairs 14 and 15 of transport rollers are rotated in the initial direction to transport the recording sheet 10 forwardly. The thermal head 18 records a magenta frame line by line in the magenta developing thermosensitive layer 27 in the same way as for the yellow frame recording, while the recording sheet 10 is transported forwardly.

Synchronously with the magenta frame recording, the magenta fixing lamp 43*a* of the second optical fixing device 43 is turned on to project electromagnetic rays of about 365 nm toward the recording sheet 10 guided along the guide plate 40, thereby fixing the magenta developing thermosensitive layer 27. Because the quantity of light to be applied for fixing the magenta developing thermosensitive layer 27 has no upper limit, there is no need to insert the shutter 47 for prevent over-exposure.

When the magenta frame has been completely recorded and fixed, the thermal head 18 is set back to the rest position again, and the first and second pairs 14 and 15 of transport rollers are stopped and then rotated reversely to move the recording sheet 10 back to the predetermined position for starting recording a cyan frame.

The cyan frame recording is performed in the same way as for the other colors. Throughout the cyan frame recording, the magenta fixing lamp 43*a* projects electromagnetic rays for bleaching the recording sheet 10. When the three color frames have been recorded in this way, the rollers 14 and 15 continue rotating to transport the recording sheet 10 forwardly to eject the recording sheet 10 through the ejection passageway 16. On the other hand, the main body 45 and the supporting member 44 are rotated in reverse order as shown from FIG. 4D to 4A, to set the first optical fixing device 42 in the fixing position in place of the second optical fixing device 43.

If the illuminance of the lamp 42*a* or 43*a* changes for some reason, the illuminance measurement circuit 67 detects it through the photosensor 60, and controls drive voltages to the lamp 42*a* or 43*a* through the voltage regulator 69 so as to maintain the quantity of light applied from the lamp 42*a* or 43*a* constant. Because the photosensor 60 is placed out of a zone between the recording sheet 10 and the optical fixing device 42 or 43, the photosensor 60 will not interfere with the light applied to the recording sheet 10, nor receive light reflected from the recording sheet 10. Moreover, because the photosensor 60, as well as the recording sheet 10, receives light from the intermediate portion of the lamp 42*a* or 43*a* where the luminance is approximately uniform and maximum, the photosensor 60 can detect an illuminance value that is approximately equal to the illuminance on the recording sheet 10.

Figure 8A:
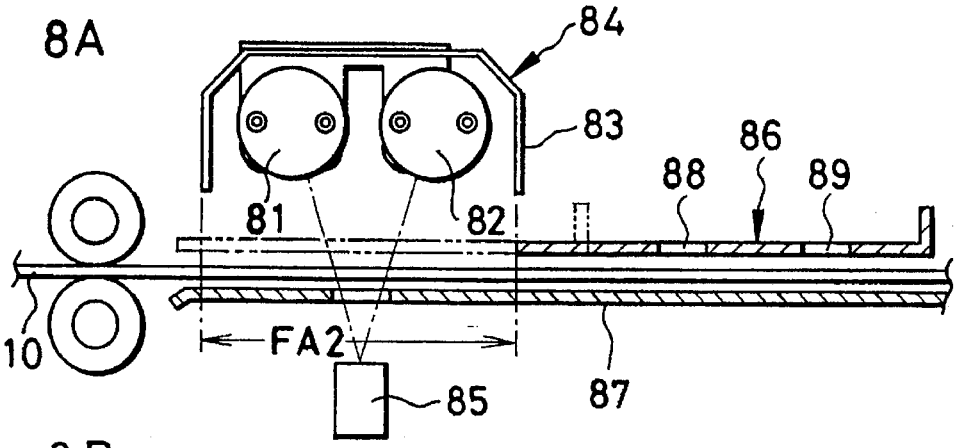
FIGS. 8A, 8B and 8C are explanatory views illustrating the relationship between an optical fixing device having a pair of lamps, a shutter and a total exposure amount of a trailing end portion of the recording sheet, according to another embodiment of the invention.

Although each of the optical fixing devices 42 and 43 has a single lamp 42*a* or 43*a* in the embodiment shown in FIG. 3, the present invention is applicable to an optical fixing device 84 as shown in FIG. 8A, wherein a pair of yellow fixing lamps 81 and 82 are disposed under a common reflector 83. In FIG. 8A, designated by 85, 86 and 87 are a photosensor, a shutter and a guide plate, respectively.

The shutter 86 of this embodiment has a pair of lateral openings 88 and 89 which are parallel to the lateral direction traversing the transport path of the recording sheet 10, and are spaced along the transport path. The widths of the lateral openings 88 and 89 and the spacing between the lateral openings 88 and 89 should be determined in correspondence with the distribution of illuminance in an illumination area FA2, as shown by dashed lines in FIG. 8B. Specifically, the lateral openings 88 and 89 are adapted to compensate for the lack or depressions in illuminance at a middle and a leading end fractions of the illumination area FA2.

Figure 8B:
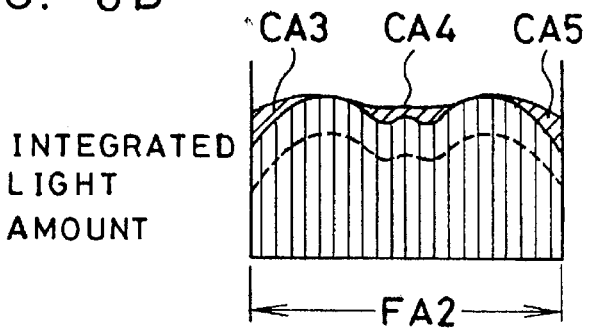
Figure 8C:
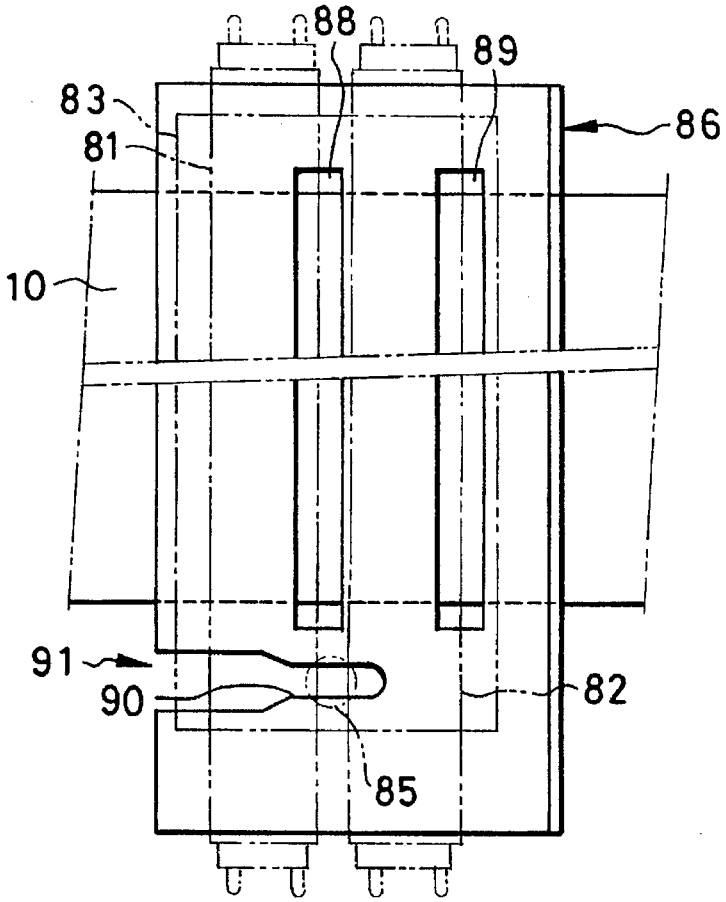

Also, a photometric slit 91 with a narrower internal end portion 90 is formed through the shutter 86 such that light from the lamps 81 and 82 falls on the photosensor 85 through the slid 91. Because the narrower internal end portion 90 of the photometric slit 91 moves in the light path to the photosensor 85 when the shutter 89 is approaching the closed position, as shown in FIG. 8C, the illuminance increases in the end stage of the shutter insertion. As a result, the distribution of exposure amount in the trailing end portion of the recording sheet 10 at the end of shutter insertion would be as shown in FIG. 8B, wherein obliquely hatched portions CA3, CA4 and CA5 show the increments obtained by the increased illuminance in the end stage of the shutter insertion, as well as by the supplementary illumination through the lateral openings 88 and 89.

In the above-described operation, optical fixing is performed concurrently while the recording sheet 10 is transported through the thermal head 18 in the forward direction, and the shutter 47 or 86 begins to be moved to the closed position immediately after the recording sheet 10 stops being transported in the forward direction. It is alternatively possible to perform optical fixing while the recording sheet 10 is transported in the reverse direction after the completion of thermal recording. Also in this alternative, the shutter 47 or 86 having the lateral opening 80 or openings 88 and 89 and the photometric slit 64 or 91 is useful for equalizing the total exposure amount in the end portion of the recording sheet 10.

Figure 9:
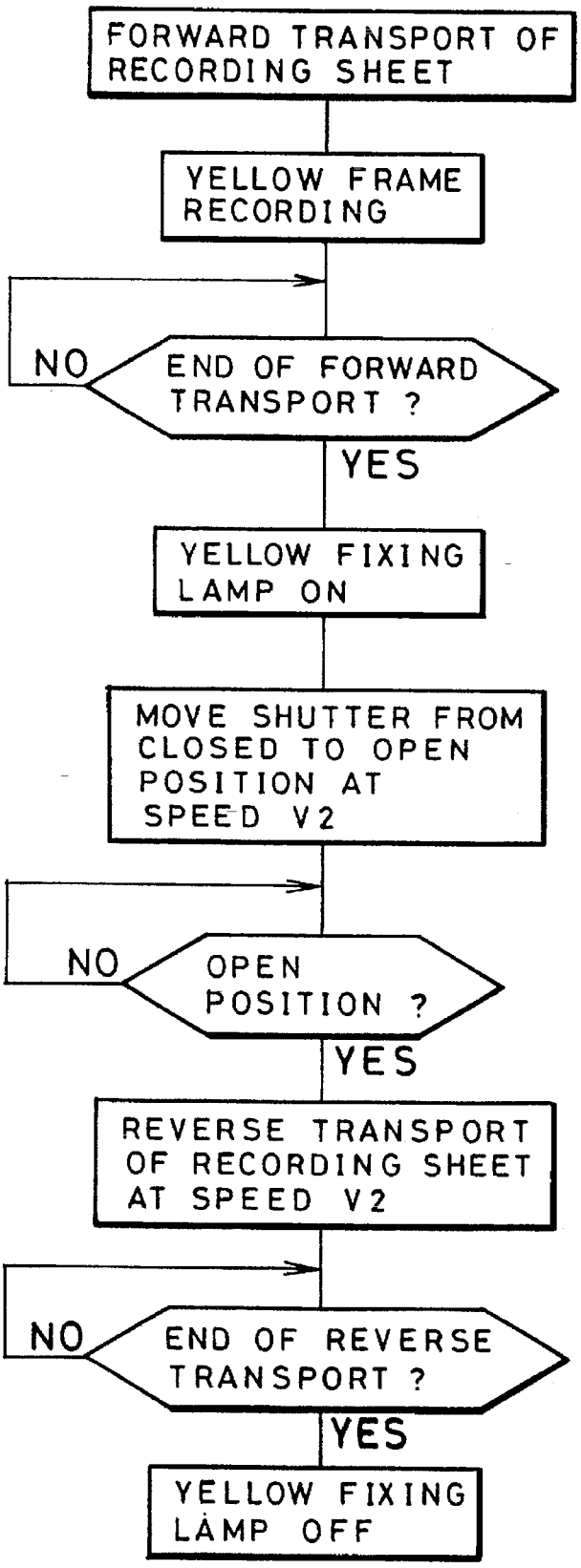
FIG. 9 is a flow chart illustrating another operation sequence of the thermal printer with the shutter according to the present invention.
Figure 10:
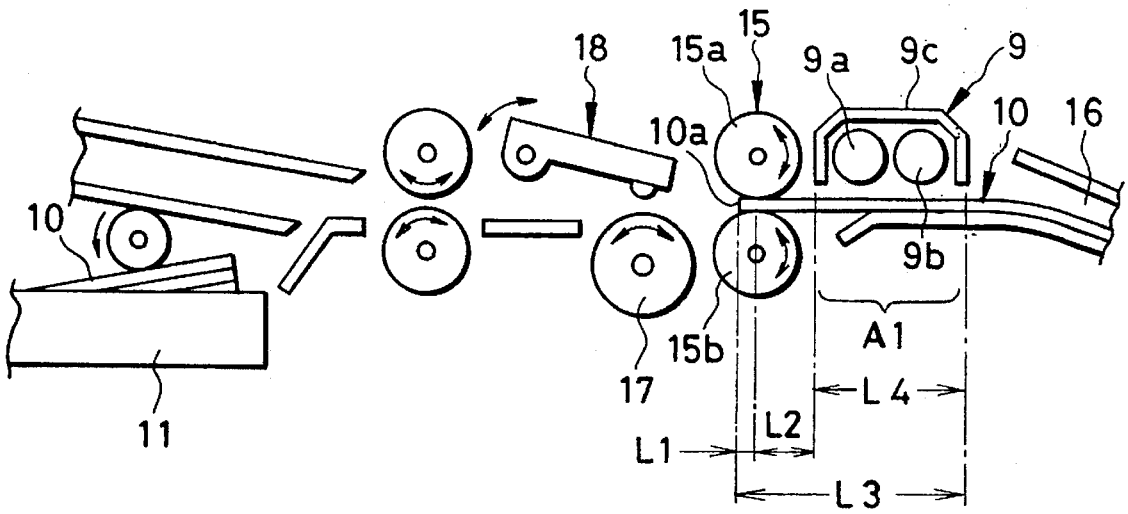
FIG. 10 (PRIOR ART)
FIG. 10 is a schematic diagram illustrating essential parts of a conventional back-and-forth type color thermal printer.

FIG. 9 shows the sequence of this alternative operation. The shutter 47 is previously located in the closed position, and the yellow fixing lamp 42*a* is turned on. First when the second pair 15 of transport rollers stop rotating in the forward direction with the trailing end of the recording sheet 10 nipped therebetween, the shutter 47 begins to be moved to the open position at a speed V2. As a result, the trailing end portion of the recording sheet 10 receives light from the yellow fixing lamp 42*a* to a degree as shown in FIG. 12D under an ideal illuminating condition where the illuminance in the illumination area FA is uniform as shown in FIG. 12B.

Immediately after the shutter plate 47 reaches the open position, the second pair 15 of transport rollers start rotating to transport the recording sheet 10 in the reverse direction at the same speed V2 as the shutter opening. The speed V2 can be different from or equal to the speed V1 of forward transport of the recording sheet 10. As a result, the total exposure amount of the recording sheet 10 becomes substantially constant in the entire area of the recording sheet 10. Because the actual illuminance distribution in the illumination area FA is as shown in FIG. 12F, the total exposure amount in the trailing end portion of the recording sheet 10 would result in the condition as shown in FIG. 12C, if the shutter 47 did not have the lateral opening 80 and the photometric slit 64.

However, because of the lateral opening 80 and the photometric slit 64, the lack of illuminance in the leading and trailing end fractions of the illumination area FA is compensated for in the same way as above, so that the total exposure amount of the trailing end portion of the recording sheet 10 in this alternative operation would also be as shown in FIG. 6C.

It is possible to disposed more than two lamps in the same reflector, and form a corresponding number of lateral openings through a shutter. The widths and spacings of these photometric slits should be modified in correspondence with the distribution of illuminance in an illumination area. Also, the length and width of the photometric slit should not be limited to the shown embodiment, but may be determined appropriately in correspondence with the distribution of illuminance in an illumination area. For example, the width of the photometric slit may be changed in two or more steps or in a continuous fashion.

The shutter may have only one of the lateral opening (or openings) and the photometric slit.

Although the above-described embodiments relate to thermal printers for recording on a sheet of recording medium cut in a predetermined length, the present invention is applicable to such a back-and-forth type thermal printer that transports a long continuous strip of recording medium through a thermal head and a fixing station.

Although the first and second optical fixing devices 42 and 43 are replaced with each other by rotating the supporting member 44 and the main body 45 in cooperation with each other in the above embodiment, it is possible to replace the fixing devices 42 and 43 with each other merely by rotating the supporting member 44. But this configuration requires a larger space. It is also possible to use a shift mechanism instead of the supporting member 44.

The shutter may be a plate or a screen. The shutter can be supported on a rotary shaft so as to be pivotally moved between the open and closed positions.

The present invention is applicable to a thermal printer for use with a thermosensitive recording medium which can develop a single color.

It is possible to control the transport speed of the recording sheet and/or the speed of shutter movement in accordance with the illuminance value measured by the photosensor.

Thus, the present invention should not be limited to the above described embodiments but, on the contrary, various modifications may be possible to those skilled in the art without departing from the scope of the appended claims.

What is claimed is:

1. A thermal printer for use with a recording medium having at least a thermosensitive layer which develops a color when heated and is fixed when exposed to a predetermined quantity of electromagnetic rays of a specific kind, the thermal printer comprising:

a thermal head which records an image to the thermosensitive layer while the recording medium is transported along a transport path;

a the first fixing lamp for projecting the electromagnetic rays onto the recording medium to fix the thermosensitive layer after recording, the fixing lamp extending across the transport path of the recording medium such that an intermediate portion of the fixing lamp, where luminance is approximately uniform, extends over a range exceeding a maximum width of the recording medium;

a photosensor disposed on a lateral side of the recording medium so as to receive the electromagnetic rays from the intermediate portion of the fixing lamp; and a control device for controlling the quantity of electromagnetic rays applied to the recording medium in accordance with an illuminance value detected by the photosensor.

2. The thermal printer according to claim 1, further comprises a second fixing lamp which extends parallel to the first fixing lamp such that an intermediate portion of the second fixing lamp, where luminance is approximately uniform, extends over the range exceeding the maximum width of the recording medium, wherein the photosensor is arranged to receive the electromagnetic rays from the intermediate portion of the second fixing lamp on the same condition as for the first fixing lamp.

3. The thermal printer according to claim 2, further comprising:

a transport system for transporting the recording medium along the transport path in a forward direction from the thermal head to the fixing lamps at a first speed and in a reverse direction at a second speed;

a shutter movable between a closed position where the shutter is inserted in an illumination area in front of the fixing lamps for shielding the electromagnetic rays from the recording medium, on one hand, and an open position retracted from the illumination area, the direction from the open position to the closed position being substantially reverse to the forward direction of the recording medium;

a plurality of openings formed through the shutter in parallel to the fixing lamps, the openings being opposed to low illuminance fractions of the illumination area, when the shutter is in the closed position, so as to permit supplementing the electromagnetic rays to portions of the recording medium that stop in the low illuminance fractions.

4. The thermal printer according to claim 3, further comprising:

a shutter driving device which starts to move the shutter from the open position to the closed position at the same speed as the first speed of the recording medium, immediately after the recording medium stops being transported in the forward direction with a trailing end portion of the recorded image located in the illumination area; and a lamp driving device for driving the fixing lamps while the recording medium is transported in the forward direction and then the shutter is moved to the closed position.

5. The thermal printer according to claim 3, further comprising:

a shutter driving device which starts to move the shutter from the closed position to the open position at the same speed as the second speed of the recording medium, immediately after the recording medium stops being transported in the forward direction with a trailing end portion of the recorded image located in the illumination area; and a lamp driving device for driving the fixing lamps to project the electromagnetic rays while the shutter is moved to the open position and then the recording medium is transported in the reverse direction.

6. The thermal printer according to claim 1, wherein the control device controls the quantity of electromagnetic rays generated from the fixing lamp so as to maintain illuminance of an illumination area in front of the fixing lamp to be constant, the thermal printer further comprising:

a transport system for transporting the recording medium along the transport path in a forward direction from the thermal head to the fixing lamps at a first speed and in a reverse direction at a second speed;

a shutter insertable into the illumination area, for shielding the electromagnetic rays from the recording medium, in a direction substantially reverse to the forward direction of the recording medium, the shutter being moved while the recording sheet stops with a trailing end portion of the recorded image placed in the illumination area; and a photometric slit formed through the shutter along the transport path such that a light path from the fixing lamp to the photosensor is formed through the photometric slit, the width of the photometric slit being changed to partly stop the light path and thus cause the photosensor to detect a lower illuminance value when the shutter is moved in a position where a larger quantity of electromagnetic rays should be applied to the recording medium.

7. A thermal printer for use with a recording medium having at least a thermosensitive layer which develops a color when heated and is fixed when exposed to electromagnetic rays of a specific kind, the thermal printer comprising:

a transport system for transporting the recording medium along a transport path in a forward direction at a first speed and in a reverse direction at a second speed;

a thermal head which records an image to the thermosensitive layer while the recording medium is transported in the forward direction;

a fixing lamp disposed behind the thermal head in the forward direction of the transport path and extending across the transport path, for projecting the electromagnetic rays onto the recording medium to fix the thermosensitive layer after recording;

a lamp driving device for driving the fixing lamp while the recording medium is transported in the forward direction at the constant speed and then stops with a trailing end portion of the recorded image placed in an illumination area in front of the fixing lamp;

a shutter movable between a closed position where the shutter is inserted in the illumination area, for shielding the electromagnetic rays from the recording medium, on one hand, and an open position retracted from the illumination area, the direction from the open position to the closed position being substantially reverse to the forward direction of the recording medium;

a shutter driving device which starts to move the shutter from the open position to the closed position at the same speed as the first speed of the recording medium, immediately after the recording medium stops being transported in the forward direction; and at least an opening formed through the shutter in parallel to the fixing lamp, the opening being opposed to a low illuminance fraction of the illumination area, while the shutter is moved to the closed position, so as to permit supplementing the electromagnetic rays to a portion of the recording medium that stops in the low illuminance fraction.

8. The thermal printer according to claim 7, wherein an intermediate portion of the fixing lamp, where luminance is approximately uniform, extends over the range exceeding a maximum width of the recording medium, and the thermal printer further comprises:

a photosensor which is disposed on a lateral side of the recording medium so as to receive the electromagnetic rays from the intermediate portion of the fixing lamp; and a control device for controlling illuminance of the illumination area to be constant, the control device increasing the quantity of electromagnetic rays when an illuminance value detected by the photosensor is below a predetermined level, and decreasing the quantity of electromagnetic rays when an illuminance value detected by the photosensor is above the predetermined level.

9. The thermal printer according to claim 8, further comprising a photometric slit formed through the shutter along the transport path such that a light path from the fixing lamp to the photosensor is formed through the photometric slit, the photometric slit having a decreasing width from a leading edge of the shutter in the direction toward the closed position, to gradually stop the light path and thus increases the illuminance of the illumination area as the shutter moves toward the closed position.

10. A thermal printer for use with a recording medium having at least a thermosensitive layer which develops a color when heated and is fixed when exposed to electromagnetic rays of a specific kind, the thermal printer comprising:

a transport system for transporting the recording medium along a transport path in a forward direction at a first speed and in a reverse direction at a second speed;

a thermal head which records an image to the thermosensitive layer while the recording medium is transported in the forward direction;

a fixing lamp disposed behind the thermal head in the forward direction of the transport path and extending across the transport path, the fixing lamp projecting the electromagnetic rays onto the recording medium to fix the thermosensitive layer after recording;

a lamp driving device for driving the fixing lamp to project the electromagnetic rays while a trailing end portion of the recorded image stops in an illumination area in front of the fixing lamp, as well as while the recording medium is transported in the reverse direction;

a shutter movable between a closed position where the shutter is inserted in an illumination area in front of the fixing lamp, for shielding the electromagnetic rays from the recording medium, on one hand, and an open position retracted from the illumination area, the direction from the open position to the closed position being substantially reverse to the forward direction of the recording medium;

a shutter driving device which starts to move the shutter from the closed position to the open position at the same speed as the second speed of the recording medium, immediately after the recording medium stops being transported in the forward direction with the trailing end portion of the recorded image placed in the illumination area; and at least an opening formed through the shutter in parallel to the fixing lamp, the opening being opposed to a low illuminance fraction of the illumination area, while the shutter is in the closed position, so as to permit applying a supplementary amount of electromagnetic rays to a portion of the recording medium that stops in the low illuminance fraction.

11. The thermal printer according to claim 10, wherein an intermediate portion of the fixing lamp, where luminance is approximately uniform, extends over the range exceeding a maximum width of the recording medium, and the thermal printer further comprises a photosensor which is disposed on a lateral side of the recording medium so as to receive the electromagnetic rays from the intermediate portion of the fixing lamp, and a control device for controlling illuminance of the illumination area to be constant in accordance with an illuminance value detected by the photosensor, the control device increasing the quantity of electromagnetic rays when an illuminance value detected by the photosensor is below a predetermined level, and decreasing the quantity of electromagnetic rays when an illuminance value detected by the photosensor is above the predetermined level.

12. The thermal printer according to claim 11, further comprising a photometric slit formed through the shutter along the transport path such that a light path from the fixing lamp to the photosensor is formed through the photometric slit, the photometric slit having a decreasing width from a leading edge of the shutter in the direction toward the closed position, to gradually widen the light path and thus decrease the illuminance of the illumination area as the shutter moves toward the open position.

13. A thermal printer for use with a thermosensitive recording medium having at least first to third thermosensitive layers for developing first to third colors, the thermal printer comprising:

a thermal head which records first to third color frames of a full-color image to the first to third thermosensitive layers in a frame sequential fashion while the recording medium is transported along a transport path in a forward direction;

first and second fixing lamps which are alternatively turned on for projecting first or second kind electromagnetic rays onto the recording medium to fix the first or the second thermosensitive layer, respectively, the first and second fixing lamps extending across the transport path of the recording medium such that an intermediate portion of each of the first and second fixing lamps, where luminance is approximately uniform, extends over a range exceeding a maximum width of the recording medium;

a photosensor disposed on a lateral side of the recording medium so as to receive the first or the second kind electromagnetic rays from the intermediate portion of the first or the second fixing lamp on the same condition, to detect an illuminance value; and a control device for controlling the quantity of electromagnetic rays applied to the recording medium in accordance with the illuminance value detected by the photosensor.

14. The thermal printer according to claim 13, wherein the first and second fixing lamps are supported to be movable such that one of the first and second fixing lamps is placed in a fixing position facing the recording medium behind the thermal head in the forward direction of the transport path.

15. The thermal printer according to claim 14, further comprising:

a shutter insertable into the illumination area, for shielding the electromagnetic rays from the recording medium, in a direction substantially reverse to the forward direction of the recording medium, the shutter being moved while the recording sheet stops with a trailing end portion of the recorded image placed in the illumination area; and at least an opening formed through the shutter in parallel to the fixing lamp placed in the fixing position, the opening being opposed to a low illuminance fraction of the illumination area, when the shutter is inserted in the illumination area, so as to permit supplementing the electromagnetic rays to a portion of the recording medium that stops in the low illuminance fraction.

16. The thermal printer according to claim 14, wherein the control device controls the quantity of electromagnetic rays generated from the fixing lamp placed in the fixing position so as to maintain illuminance of an illumination area in front of the fixing lamp to be constant, the thermal printer further comprising:

a shutter insertable into the illumination area, for shielding the electromagnetic rays from the recording medium, in a direction substantially reverse to the forward direction of the recording medium, the shutter being moved while the recording sheet stops with a trailing end portion of the recorded image placed in the illumination area; and a photometric slit formed through the shutter along the transport path such that a light path from the fixing lamp to the photosensor is formed through the photometric slit, the width of the photometric slit being changed to partly stop the light path and thus cause the photosensor to detect a lower illuminance value when the shutter is moved in a position where a larger quantity of electromagnetic rays should be applied to the recording medium.

* * * * *